US006664520B2

(12) United States Patent
Clothier

(10) Patent No.: US 6,664,520 B2
(45) Date of Patent: Dec. 16, 2003

(54) THERMAL SEAT AND THERMAL DEVICE DISPENSING AND VENDING SYSTEM EMPLOYING RFID-BASED INDUCTION HEATING DEVICES

(75) Inventor: Brian L. Clothier, O'Fallon, IL (US)

(73) Assignee: Thermal Solutions, Inc., Grand Forks, ND (US)

( * ) Notice: Subject to any disclaimer, the term of this patent is extended or adjusted under 35 U.S.C. 154(b) by 28 days.

(21) Appl. No.: 10/151,911

(22) Filed: May 20, 2002

(65) Prior Publication Data

US 2003/0029862 A1 Feb. 13, 2003

Related U.S. Application Data

(60) Provisional application No. 60/292,268, filed on May 21, 2001, and provisional application No. 60/352,522, filed on Jan. 31, 2002.

(51) Int. Cl.[7] ..... H05B 6/06; H05B 6/10; A47C 7/74

(52) U.S. Cl. ..... 219/634; 219/635; 219/663; 221/9; 221/150 A; 297/180.11; 297/180.12; 340/572.1; 340/825.37

(58) Field of Search ..... 219/620, 621, 219/622, 624, 634, 626, 635, 647, 649, 386, 387, 221, 661, 663; 126/246, 375, 400; 221/2, 9, 150 A, 150 R; 297/180.1, 180.11, 180.12; 340/572.1, 825.37; 99/DIG. 14, 451

(56) References Cited

U.S. PATENT DOCUMENTS

| | | | | | |
|---|---|---|---|---|---|
| 3,612,803 | A | * | 10/1971 | Klaas | 219/634 |
| 4,035,606 | A | * | 7/1977 | Browder | 219/211 |
| 6,097,014 | A | * | 8/2000 | Kirsch | 219/621 |
| 6,201,474 | B1 | * | 3/2001 | Brady et al. | 340/572.8 |
| 6,232,585 | B1 | * | 5/2001 | Clothier et al. | 219/622 |
| 6,359,268 | B1 | * | 3/2002 | Walter | 219/622 |

FOREIGN PATENT DOCUMENTS

| | | | | |
|---|---|---|---|---|
| JP | 6-124776 | * | 5/1994 | 219/635 |

* cited by examiner

*Primary Examiner*—Philip H. Leung
(74) *Attorney, Agent, or Firm*—Hovey Williams, LLP

(57) ABSTRACT

An RFID-based induction heating/vending system for quickly and efficiently heating, vending, and recollecting stadium seats (10) or other objects. The system includes a plurality of objects each including an induction-heatable body (22), a charging/vending station (12) for heating and vending the objects; a self-serve warming station (14) that may be used by consumers to reheat their objects; and a check-out station (16) that automatically collects objects from consumers after use.

13 Claims, 5 Drawing Sheets

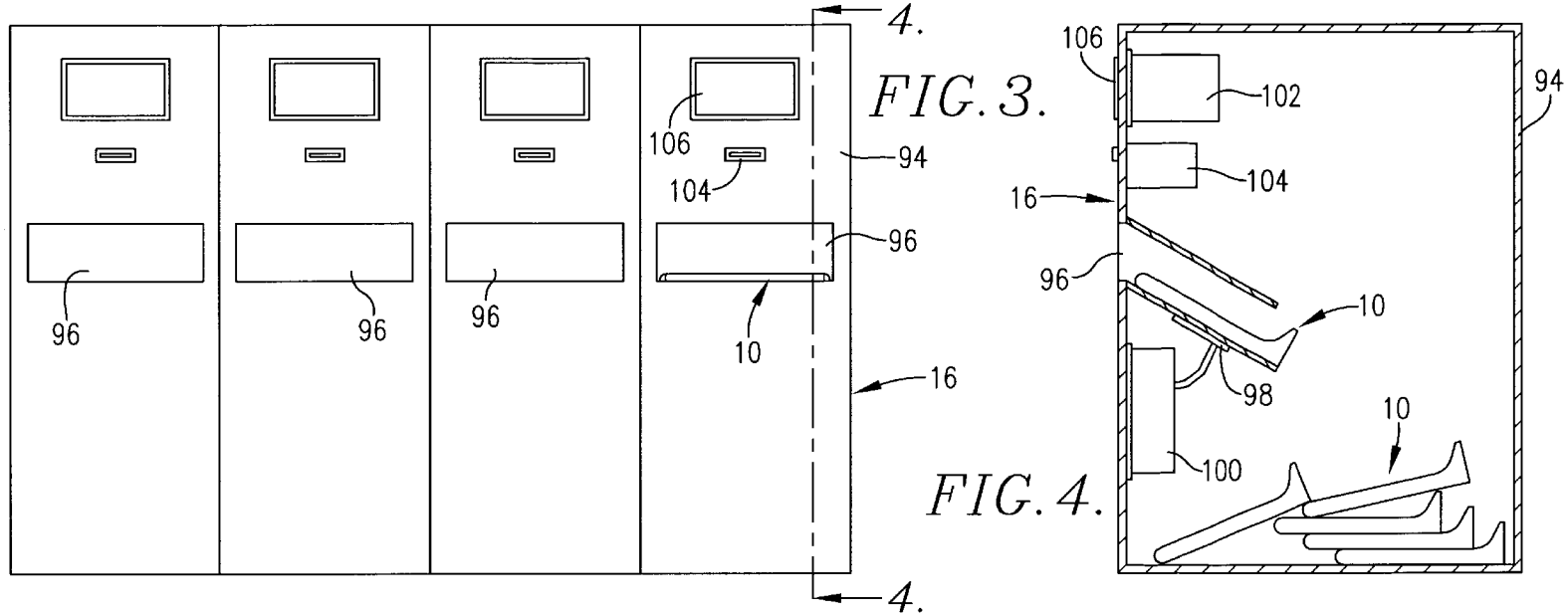
FIG. 3.
FIG. 4.
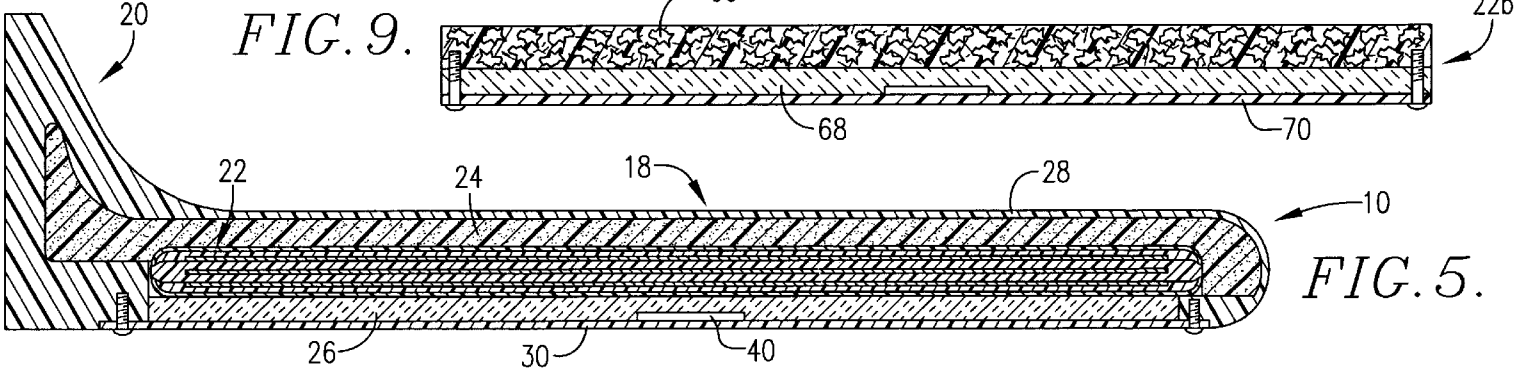
FIG. 9.
FIG. 5.

THERMAL SEAT AND THERMAL DEVICE DISPENSING AND VENDING SYSTEM EMPLOYING RFID-BASED INDUCTION HEATING DEVICES

RELATED APPLICATIONS

This application claims priority of two provisional patent applications titled "Thermal Seat and Thermal Device Dispensing and Vending System Employment RFID-Based Induction Heating Devices", Serial No. 60/292,268, filed May 21, 2001 and "Heat Retentive Inductive-Heatable Laminated Matrix", Serial No. 60/352,522, filed Jan. 31, 2002, both hereby incorporated into the present application by reference.

BACKGROUND OF THE INVENTION

1. Field of the Invention

The present invention relates to magnetic induction heating devices, systems, and methods. More particularly, the invention relates to a heat-retentive, induction-heatable body that may be embedded or inserted in stadium seats, food delivery bags or trays, or other objects to heat or warm the objects. The invention also relates to an RFID-based induction heating/vending system that may be used to quickly and easily heat and vend stadium seats, food delivery items or other objects and to then efficiently collect the objects from customers after use.

2. Description of the Prior Art

It is desirable to keep hot foods, such as pizza, warm during delivery. One method of doing so is to insert or incorporate a heat-retentive body into a food-holding container such as a pizza delivery bag to maintain the temperature of the food item during delivery. Examples of such systems and methods are disclosed in U.S. Pat. No. 6,232,585 (the '585 patent) and U.S. Pat. No. 6,320,169 (the '169 patent), both owned by the assignee of the present application and incorporated into the present application by reference. Specifically, these patents disclose temperature self-regulating food delivery systems and magnetic induction heating methods that utilize a magnetic induction heater and a corresponding induction-heatable body to maintain the temperature of a food item or other object during delivery.

Although the systems and methods disclosed in the '585 and '169 patents are far superior to prior art systems and methods for keeping food and other items warm, they suffer from several limitations which limit their utility. For example, the induction-heatable bodies disclosed in these patents cannot be heated quickly, especially to a high temperature. Induction-heatable bodies made of high cost, fine ferromagnetic materials and can be heated more quickly than those made of lower grade ferromagnetic materials, but such devices are relatively costly and heavy and thus impractical for many applications such as portable, cost-sensitive food delivery systems. Many prior art induction-heatable bodies also often develop "hot spots" when heated by a heating source having an uneven magnetic field distribution such as is provided by typical flat pancake spiral induction heating coils.

Prior art food delivery systems which incorporate induction-heatable bodies also suffer from several distinct disadvantages. For example, such systems are especially configured for holding and warming pizza, but not other types of food. Although pizza likely constitutes the largest percentage of delivered food items in the U.S., it is believed that consumers would accept and desire many other types of delivered food items if such food items could be kept warm during delivery. Specifically, it is believed that consumers would readily request the delivery of sandwiches and french fries such as those sold by the McDonald's Corporation if food delivery systems existed for maintaining the temperature of these food items during delivery.

It is also often desirable to heat objects other than food items. For example, portable, heatable seat cushions (thermal seats) are popular for use by consumers to stay warm and comfortable while seated in conventional stadium or bleacher seats during outdoor sporting events, concerts and other similar events. Several such thermal seats are disclosed in U.S. Pat. Nos. 5,545,198; 5,700,284; 5,300,105; and 5,357,693, which generally describe seat cushions including a removable envelope enclosing a fluid which can be heated in a microwave oven. A primary disadvantage of these types of thermal seats is that they do not retain heat long and therefore are unsuitable for use during many longer activities such as concerts and sporting events.

Moreover, because the fluid envelopes must be heated in microwaves, it is difficult to heat and commercially rent a large number of these types of thermal seats to customers at sporting events or concerts. The commercial rental of thermal seats has also been impractical because of the difficulties in collecting the seats back from customers after they have been used. Currently, thermal seats must be heated, vended and recollected manually, requiring too much labor to be cost-effective.

SUMMARY OF THE INVENTION

The present invention solves the above described problems and provides a distinct advance in the art of heat-retentive induction-heatable bodies, food delivery systems, and systems for vending and recollecting thermal seats.

One embodiment of the present invention is an induction heatable body that quickly heats to a desired temperature, retains heat long enough to be used in almost any application, and develops no "hot spots," even when heated by a heating source having an uneven magnetic field distribution. Moreover, the induction-heatable body of the present invention achieves the foregoing while remaining relatively lightweight, inexpensive and easy to manufacture.

A preferred embodiment of the induction-heatable body broadly includes a plurality of induction-heatable layers each sandwiched between alternating layers of heat retentive material. The induction-heatable layers preferably consist of sheets of graphite material that can be inductively heated at magnetic field frequencies between 20 and 50 kHz. The heat-retentive layers preferably consist of solid-to-solid phase change material such as radiation cross-linked polyethylene.

The skin depth of each of the induction-heatable layers is large enough to permit complete and substantially simultaneous inductive heating of all of the layers when the induction-heatable body is placed on or in the vicinity of an induction heating coil. This allows a great amount of surface area to be simultaneously heated so that the induction-heatable body is quickly heated to a desired temperature by a typical induction heating coil and retains the heat for a long period of time. The alternating layers of induction-heatable material and heat-retentive material quickly and uniformly conduct heat so that any "hot spots" created during heating of the induction body are quickly eliminated.

Another embodiment of the present invention is a food delivery assembly uniquely adapted and configured for maintaining the temperature of sandwiches, french fries, and other related food items such as those sold by the McDonald's Corporation. The food delivery assembly broadly includes a magnetic induction heater, a food container, and a delivery bag for carrying and insulating the food container. The magnetic induction heater operates under the same principles as disclosed in the '585 and '169 patents but is specially sized and configured for heating the food container of the present invention. The preferred magnetic induction heater includes an L-shaped base or body with an induction heating coil positioned in or on each leg of the body. The magnetic induction coils are controlled by a common control source and are coupled with an RFID reader/writer.

The food container preferably includes an outer, open-topped box, an inner open-topped box that fits within the outer box, a plurality of divider walls that fit within the inner box to subdivide it for receiving several separate food items, and a lid that fits over the open top of the inner box to substantially seal the food container and retain heat therein. The food container may be sized and configured for holding any types of food items such as sandwiches and french fries sold by the McDonald's Corporation. Two induction-heatable cores are positioned on two exterior walls of the inner box and are sized and oriented so as to be positioned adjacent the induction heating coils of the magnetic induction heater when the food container is placed on the heater. The induction-heatable cores are preferably substantially identical to the induction-heatable body described above. An RFID tag and thermal switch are also coupled with the induction-heatable cores and operate substantially the same as described in the '585 and '169 patents.

The delivery bag is preferably formed of lightweight, flexible, insulative material and includes a compartment for receiving and insulating the food container. The delivery bag may also include a separate compartment for receiving and insulating cold food items such as soft drinks.

Another embodiment of the present invention is an RFID-based induction heating/vending system for quickly and efficiently heating, vending, and recollecting stadium seats or other objects used during sporting events, concerts, and similar events. The system broadly includes any number of thermal seats each including an induction-heatable body such as the one described above; a charging/vending station for heating and vending the seats; a self-serve warming station that may be used by consumers to reheat their seats; and a check-out station in which consumers may deposit their thermal seats after an event.

The thermal seats are configured for placement on conventional stadium or bleacher seats for increasing the comfort and warmth of the seats. Along with an induction-heatable body, each thermal seat includes one or more layers of solid state phase change material designed to store a vast amount of thermal energy. The thermal seats can be inductively heated on an RFID induction heater and each contains an RFID tag so as to allow it to be temperature regulated as per the '169 and '585 patents. These tags maybe linked to a thermal switch, also as described in the '169 patent. The RFID tags also store customer information, such as credit card numbers, and the time and date seats were given to customers. This information is stored on an RFID tag of a seat while it is heated by the induction heaters of the charging/vending station as described below.

The charging/vending station includes one or more induction heaters as described in the '585 patent, an RFID reader/writer associated with each heater, and a credit card reader, which may be connected to more than one induction heater with a microprocessor controlling the flow of information. When it is desired to vend a seat to a customer, the seat is placed on top of one of the induction heaters and the customer's credit card is scanned. As the credit card is scanned, the information on the card is sent to the RFID reader/writer associated with the induction heater and then written to the RFID tag of the thermal seat being vended. At about the same time, the RFID reader/writer reads and recognizes the class of object code on the RFID tag embedded in the thermal seat and executes a specific heating algorithm designed to efficiently bring the seat to a pre-selected temperature and maintain it there without input from the vendor. The charging/vending station also preferably includes a simple control system such as a red light to indicate charging and a green light to indicate that charging is complete so that a seat may be removed from the heater and vended to a customer.

The self-serve warming station is similar to the charging/vending station but lacks the cash register and card reader. The warming station includes one or more induction heaters and an RFID reader/writer associated with each heater. The warming station allows customers to reheat their seat should the seats not stay hot during the entire duration of an event. Furthermore, a customer who has rented a thermal seat can use the self-serve station to initially heat his or her thermal seat if there is a line at the charging/vending station.

A vendor or customer may also use the charging/vending station or the self-serve warming station to initially heat or reheat food delivery containers or other devices during an event. Many self-serve warming stations could be placed at strategic locations around a stadium or other venue to allow easy access for customers or vendors. Simple instructions at each station would allow customers and vendors to easily and safely heat their thermal seats, food delivery containers or other items without assistance.

The check-out station includes a substantially enclosed housing having one or more openings or "chutes" into which thermal seats may be placed so as to irretrievably fall into the housing. An RFID antenna is positioned adjacent each chute and is in communication with an RFID reader/writer and microcontroller control unit. The RFID antenna reads the RFID tag of a thermal seat as it is deposited in the housing. The RFID reader/writer and microcontroller control unit communicate with a receipt printer to dispense a receipt shortly after a seat has been placed into the chute. The microcontroller control unit also stores transaction information, including the time and date each seat was returned, so that the information can be immediately or subsequently retrieved either through a direct cable connection, a modem, or a wireless modem. The transaction information can then be compiled with that of other check-out stations so as to effectively monitor the status of all vended thermal seats.

The control unit of the check-out station preferably has a user interface similar to those found in other automated vending systems such as self-serve gas pumps. The user interface instructs a customer to place a thermal seat into the chute and to then take his or her receipt. The simple operation of the check-out stations allows a large number of thermal seats to be quickly returned without intervention by paid staff members.

The heating/vending system of the present invention provides numerous advantages not found in the prior art. For example, the thermal seats can be quickly, easily and automatically heated to a predetermined temperature on an RFID-equipped induction heater. The RFID tag embedded in each seat can receive and store customer information during the vending process so as to identify the customer when the seat is returned.

The charging/vending station allows the thermal seats to be initially heated by a vendor and simultaneously loaded with the customer's identification information at the time of vending. The check-out station may then be used to return seats, identify a returned seat, identify the customer who rented it, identify the time at which the seat was returned, give the customer a receipt immediately showing his charges, and store the transaction information for immediate or future download to a central data base.

The self-serve warming station allows customers and vendors to easily reheat seats during an event. Advantageously, the warming station can bring a seat back to its pre-determined temperature without any input from the consumer.

The charging/vending station and self-serve warming station may also be used to heat other objects such as food delivery bags and trays. Consumers could use these bags and trays to keep their food warm during sporting events, concerts, and other events and then return the bags or trays to the check-out station as described above.

BRIEF DESCRIPTION OF THE DRAWING FIGURES

Several preferred embodiments of the present invention are described in detail below with reference to the attached drawing figures, wherein:

FIG. 3 is a front elevational view of a check-out station of the induction heating/vending system;

FIG. 4 is a vertical section view of the check-out station taken along lines 4—4 of FIG. 3;

FIG. 5 is a vertical section view of a thermal seat of the induction heating/vending system and having a preferred laminated core and an RFID tag positioned within the seat;

FIG. 9 is a vertical section view of a matrix type core that may be positioned within the seat of FIG. 5 instead of the laminated core;

Figure 1:
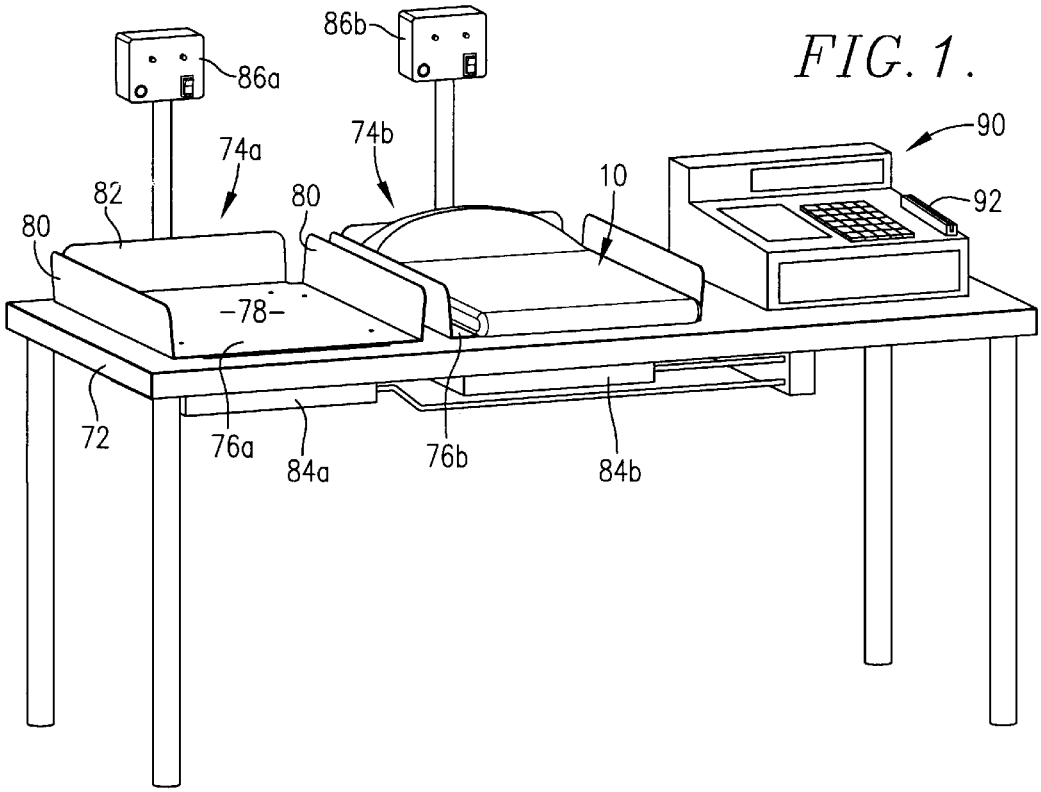
FIG. 1 is a perspective view of a charging/vending station constructed in accordance with a preferred embodiment of an induction heating/vending system of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS EMBODIMENTS OF FIGS. 1–9

Figure 2:
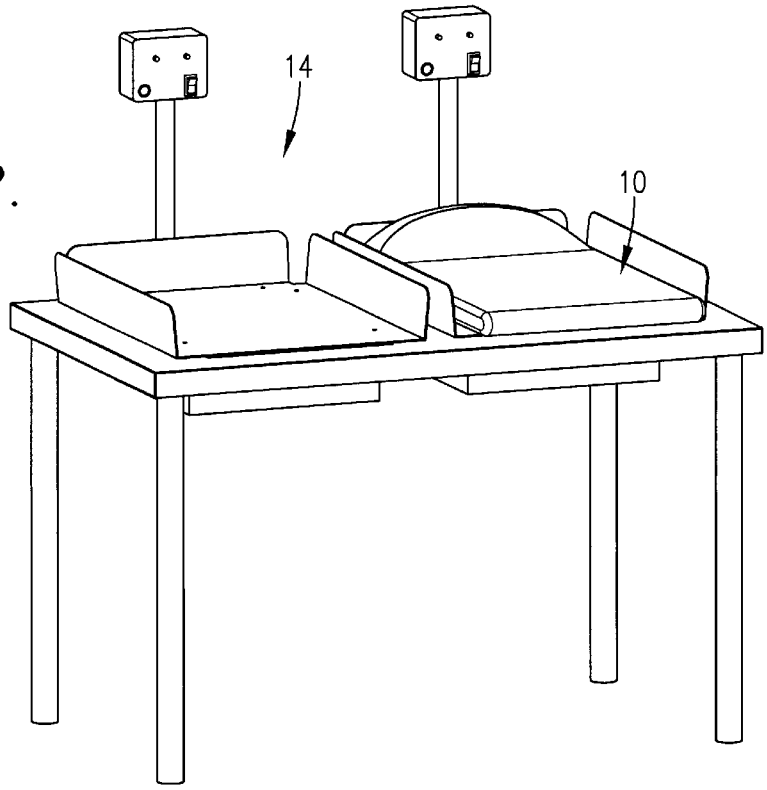
FIG. 2 is a perspective view of a self-serve warming station of the induction heating/vending system.

Turning now to the drawing figures, and particularly FIGS. 1–3, an induction heating/vending system that may be used for heating, vending, and then recollecting stadium seats, food delivery bags, trays, or any other induction-heatable objects is illustrated. The heating/vending system broadly includes a plurality of objects to be heated such as thermal seats 10, food delivery bags or trays; at least one charging/vending station 12 for heating and vending the objects; at least one self-serve warming station 14 that may be used to initially heat or reheat the objects; and at least one check-out station 16 that may be used by customers to return the objects after use. Each of these components is described in more detail below. Referring to FIGS. 4–9, several embodiments of induction-heatable bodies that may be used with the heating/vending system or with other systems or devices such as food delivery bags are illustrated. The induction-heatable bodies are described below in connection with the thermal seats of the heating/vending system.

Thermal Seats

As mentioned above, the heating/vending system may be used to heat and vend any objects such as thermal seats 10, food delivery bags, food delivery trays etc. For the purposes of describing a preferred embodiment of the invention, however, only thermal seats 10 will be described and illustrated in detail herein.

The thermal seats 10 are designed to be heated and then placed on conventional stadium or bleacher type seats to warm and increase the comfort of the seats. As best illustrated in FIG. 5, each seat 10 is generally in the shape of a conventional stadium seat and includes a seat portion 18 and a partial seat back 20 for lumbar support. The seat portion 18 broadly includes an induction-heatable core or body 22, a layer of phase change foam 24 positioned over the core 22, a layer of insulation 26 positioned underneath the core 22, and a seat cover 28 encapsulating the core 22, phase change foam 24, and insulation 26.

The induction-heatable core 22 can be heated by either the charging/vending station 12 or self-serve warming station 14 as described in more detail below. The present invention includes several different embodiments of the induction heatable core 22, each described separately below.

The phase change foam layer 24 is preferably formed from a foam polymer material with a solid-to-solid phase change polymer blended into the foam. One such material is sold by Frisby Technologies of North Carolina under the name ComforTemp™. ComforTemp™ foam contains a free-flowing micro-encapsulated phase change material marketed under the name THERMASORB™ that can have phase change temperatures anywhere from 43° F. to 142° F. The preferred phase change temperature for the thermal seat is 95° F. THERMASORB™ powder may also be blended into other high temperature resistant foams such as silicone foam.

The purpose of the phase change foam layer 24 is two-fold. First and foremost, the foam absorbs energy from the upper surface of the induction-heatable core 22 and changes the phase of the THERMASORB™ particles. The large latent heat of the THERMASORB™ particles acts to buffer the temperature of the seat cover 28 surface to maintain a preferred temperature of 95° F. for a prolonged period of time. As the thermal energy stored in the core 22 and phase change layer 24 is released (both as latent heat at approximately 230° F. and as sensible heat during the cool down after induction heating is completed), the phase change foam layer 24 continues to absorb this energy while the top surface of the seat cover 28 is transferring this energy to the posterior of the customer and the ambient environment.

The second purpose of the phase change foam layer 24 is to provide a supple, pliable cushion for comfort purposes. Because the seat cover 28 is made from pliable materials, it evenly distributes a customer's weight with the help of the phase change foam layer 24.

The layer of insulation 26 beneath the core 22 is provided to reduce heat loss from the core 22 and direct heat released from the core 22 upward toward the phase change foam layer 24. The insulation layer 26 may be formed of ay conventional insulation material having a high R value.

The seat cover 28 is preferably made of pliable, hard, durable plastic such as polyurethane or polypropylene that is thick enough to withstand scuffing, impact, and harsh elements such as rain and snow. The seat cover 28 preferably has a removable bottom panel 30 that may be removed to insert and/or gain access to the induction heatable core 22. The bottom panel 30 fastens into the remaining portion of the seat cover 28 with conventional fasteners or adhesive.

Laminated Core

Figure 6:
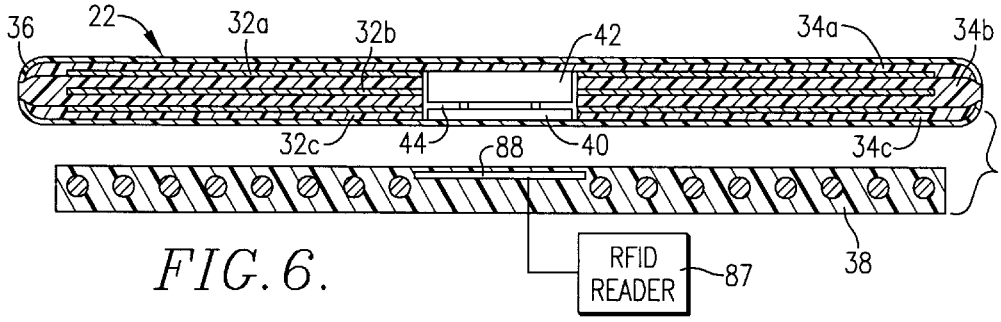
FIG. 6 is a vertical sectional view of the laminated core of FIG. 5 and also including a thermal switch and shown in proximity to a magnetic induction heating element.

As mentioned above, the induction-heatable core 22 may be constructed in accordance with several different embodiments of the invention. The preferred embodiment is illustrated in FIGS. 5 and 6 and includes a laminated matrix composed of at least two types of materials: 1) a graphite material in sheet form that can be inductively heated at magnetic field frequencies between 20 and 50 kHz, and 2) an insulative heat retentive polymer material that can be bonded, preferably without a separate bonding agent to the graphite material. Specifically, the preferred core includes alternating layers of induction-heatable graphite material 32*a, b, c* and heat-retentive polymer material 34*a, b, c* encapsulated in a shell 36 or casing of high-density polyethylene.

The graphite layers 32*a, b, c* are preferably formed from a flexible graphite sheeting material such as GRAFOIL® Flexible Graphite or EGRAF™ sheeting made and marketed by Graftech, Inc., a division of UCAR Carbon Company of Lakewood, Ohio. The graphite layers 32*a, b, c* may also be formed from a BMC 940™ rigid graphite-filled polymer material available from Bulk Molding Compounds, Inc. of West Chicago.

GRAFOIL® Flexible Graphite and EGRAF™ sheeting are graphite sheet products made by taking high quality particulate graphite flake and processing it through an intercalculation process using strong mineral acids. The flake is then heated to volatilize the acids and expand the flake to many times its original size. No binders are introduced into the manufacturing process. The result is a sheet material that typically exceeds 98% carbon by weight. The sheets are flexible, lightweight, compressible, resilient, chemically inert, fire safe, and stable under load and temperature. However, it is the anisotropic nature of the material, due to its crystalline structure, that provides some of the benefits for use in the laminated matrix core 22 of the present invention.

GRAFOIL® Flexible Graphite and EGRAF™ are significantly more electrically and thermally conductive in the plane of the sheet than through the plane. It has been found experimentally that this anisotropy has two benefits First, the higher electrical resistance in the through-plane axis allows the material to have an impedance at 20–50 KHz that allows a magnetic induction heater (such as the induction coil 38 in FIG. 6) operating at these frequencies to efficiently heat the material while the superior thermal conductivity in the plane of the sheet allows the eddy current heating to quickly equilibrate temperatures across the breadth of the sheet.

Second, and most important, the material can be inductively heated through successive layers at the same time, where each layer is electrically insulated from the next. That is, a laminated structure of several layers 32*a, b, c* of GRAFOIL® intermixed with layers 34*a, b, c* of insulative material, such as that shown in FIGS. 5 and 6, will have eddy currents induced in each layer of GRAFOIL® material. Experiments show that for magnetic induction heating occurring at 20–50 kHz for a laminated matrix configuration as shown in FIGS. 5 and 6, each graphite layer is inductively heated at equivalent heating rates. A higher magnetic field frequency lessens the required total thickness of graphite in the laminated, as measured by the summation of its layers' thicknesses, that will heat each layer at equivalent heating rates.

This equal-heating-rate of successive graphite layers 32*a, b, c* separated by insulative layers 34*a, b, c* is unknown in conventional ferromagnetic induction heating elements. If the induction-heatable core of FIGS. 5 and 6 was constructed using steel sheeting rather than GRAFOIL® sheeting, only the steel sheet nearest the induction heating coil would experience significant Joule heating. This multilayer heating phenomenon of GRAFOIL®, EGRAF™, BMC 940™ and other graphite sheeting materials combined with the alternating layers of insulative polymer layers provide many unexpected advantages relating to thermal energy storage. For example, much more power can be applied to the laminated core 22 of FIGS. 5 and 6 without superheating any portion thereof than can be applied to a similar mass of heat retentive material having a single layer of ferromagnetic material embedded therein. This is true because each thin layer of heat retentive polymer 34*a, b, c* in the laminated core 22 has an adjacent surface layer of graphite material 32*a, b, c* providing a conductive heat source to drive the thermal energy quickly through its plane without superheating the graphite layers or the graphite/polymer interface. Most of the thin layers of heat retentive polymer 34*a, b, c* have two adjacent layers of graphite material 32*a, b, c* for even faster thermalization. It has been found that a heat retentive core 22 of the configuration shown in FIGS. 5 and 6, using GRAFOIL® graphite layers, can accept an input power via an induction heating process three times that of an equivalent thermal mass having a single layer of induction-heat able material. This is true even when no portion of the heat retentive material is heated more than 50° F. above its solid-to-solid phase change temperature.

Another benefit of the anisotropic nature of the GRAFOIL® and EGRAF™ materials is the extremely high thermal conductivity in the plane of sheets of the material. This extremely high conductivity virtually prevents edge effect from occurring during induction heating of a segment of GRAFOIL® or EGRAF™ sheeting that is smaller than the surface area of the induction heating coil 38. Edge effect during induction heating of a ferromagnetic sheet of material is well known in the prior art: the edges of a ferromagnetic sheet can become significantly hotter than the rest of the sheet if the edge rests within the induction heating coil's surface boundary. The GRAFOIL® and EGRAF™ materials are so conductive in the plane of the sheet that temperatures are nearly instantaneously equilibrated across the sheeting, even with a non-uniform magnetic field density produced by the induction heating coil.

Because GRAFOIL® and EGRAF™ materials contain no binder, they have very low density. The standard density is 1.12 g/ml. It has been found that three sheets of 0.030" thick GRAFOIL®C Grade material in the configuration shown in FIGS. 5 and 6 couple as much energy from a COOKTEK™ C-1800 induction cooktop operating at 30 kHz as a 0.035" thick sheet of cold rolled steel when the spacing between the cold rolled steel sheet and the induction heating coil is identical to the spacing between the closest sheet of GRAFOIL® and the induction heating coil. Furthermore, the total mass of GRAFOIL® that couples an identical amount of energy weighs 60% less than the cold rolled steel.

BMC 940™ is often used for conductive plates in fuel cells and has been found to be capable of induction heating at frequencies of between 30 and 50 kHz. The material is much lighter than metal and can be compression molded into various shapes. The skin depth of this material at the above mentioned frequencies is very large so that it can be evenly through-heated over approximately 1 inch of thickness. BMC 940™ sheeting shows similar properties to those just described for GRAFOIL® and EGRAF™. However, due to the binder required in the BMC 940™, the induction coupling efficiency is not as high as that of the GRAFOIL®, nor is the thermal conductivity within the plane of the sheeting as high. Thus, although it works for this invention, BMC 940™ is less desirable than GRAFOIL® or EGRAF™ for use as the inductively heatable layers 32*a, b, c*.

The insulative, heat retentive polymer layers 34*a, b, c* are preferably formed from a solid-to-solid phase change material such as radiation crosslinked polyethylene. The radiation crosslinking procedure for polyethylene is described in detail in the '585 patent. The preferred form of polyethylene for use as the heat retentive layers is off-the-shelf polyethylene sheeting, in any density whose melting temperature (which after crosslinking becomes a pseudo solid-to-solid phase change temperature) suits the application for which the matrix is being prepared. Of course, other phase change polymers that can be made into sheet form or other non-phase change polymers such as nylon, polycarbonate, and others can be used as the heat retentive layers.

The preferred core 22 also includes either an RFID tag alone 40 (as in FIG. 5) or an RFID tag 40 connected to a thermal switch 42 (as in FIG. 6). The method of temperature regulation that the RFID tag 40 or RFID tag 40 and thermal switch 42 combination allows, when used in conjunction with an induction heater that incorporates a RFID reader/writer, is fully described in the '169 patent. This method of induction heating and temperature regulation allows the induction-heatable core 22 to be employed in various products without the need to access any portion of the core to control its ultimate temperature during heating. The core 22 may also be inductively heated simply by applying a known power for a known period of time.

Although not illustrated, the induction-heatable core 22 may also include a layer of ferromagnetic material. The ferromagnetic layer may be formed from cold rolled steel or any other alloy and may provide temperature feedback to the induction cooktop to regulate the temperature of the core. To enable all of the graphite layers 32*a, b, c* to be heated as well as the ferromagnetic layer, the graphite layers 32*a, b, c* must be placed nearest the induction work coil 38. This way, the magnetic field will simultaneously induce eddy currents in both the graphite layers and the ferromagnetic layer.

The laminated core 22 can be made in several different ways. One method is to laminated large sheets of the graphite and phase change materials in a heated lamination press. In this case, after the lamination is complete, the final desired shape of the core is achieved by die cutting or otherwise cutting the resultant sheet-sized laminated matrix. This manufacturing method is less labor intensive, and thus less expensive than the next method described below. This method and structure is suitable for induction-heatable cores that will be encased by their intended product such as the thermal seats 10 illustrated and described herein.

The laminated core 22 can also be made by laminating pre-cut sheets of the graphite and phase change materials that are stacked properly in a lamination press. In this case, it is preferable to make a jig or stack-up tool that fits in the lamination press to allow the peripheral edges of the heat retentive polymer to be sealed together during the lamination pressing. The graphite layers are then sealed within the core, which prevents de-lamination during repeated heatings and also prevents foreign matter such as liquids from seeping between layers of the laminated core. This method of manufacture is preferable for cores that are not sealed within a cavity or cover but instead are intended to be used alone as a heat source. This method is also preferable when the laminated core contains a layer of ferromagnetic material such as cold rolled steel that is difficult to die cut.

Regardless of which of the above-described manufacturing methods is used, the laminated cores 22 are made in a lamination press under controlled temperature and pressure, preferably 300° F. and 50 psi. The cool down rate of the press is controlled to prevent stresses within the core that would cause warpage after removal from the press. The crosslinked polyethylene acts as an adhesive to bond the polymer layers to the graphite layers. For other polymer materials, a bonding agent may be used.

The RFID tag 40 and switch 42 can be inserted in the core 22 either in the stack-up so that the tag/switch combination is fully encased within walls of the laminated matrix or after the lamination has been completed. In the first case, the tag/switch combo is potted with a material such as epoxy. The potted assembly is placed in a hollow formed by center-cut holes in the inner layers of graphite and heat retentive polymer. The lamination press then squeezes the layers together so as to use the adhesive nature of the crosslinked polyethylene to bond the tag/switch to the laminated core 22.

In the latter case, an opening 44 is cut in the center of the layers 32*a, b, c* and 34*a, b, c* of the core 22 as depicted in FIG. 6. After the core 22 is removed from the lamination press, the tag/switch is placed into the opening and then potted in place with an adhesive such as epoxy.

Peg-Type Core

Figure 7:
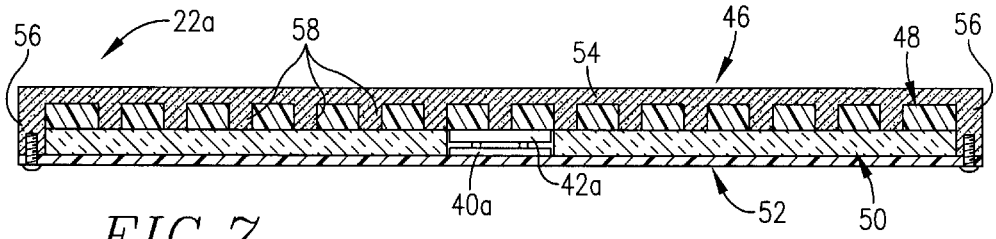
FIG. 7 is a vertical section view of a peg-type core that may be positioned within the seat of FIG. 5 instead of the laminated core.
Figure 8:
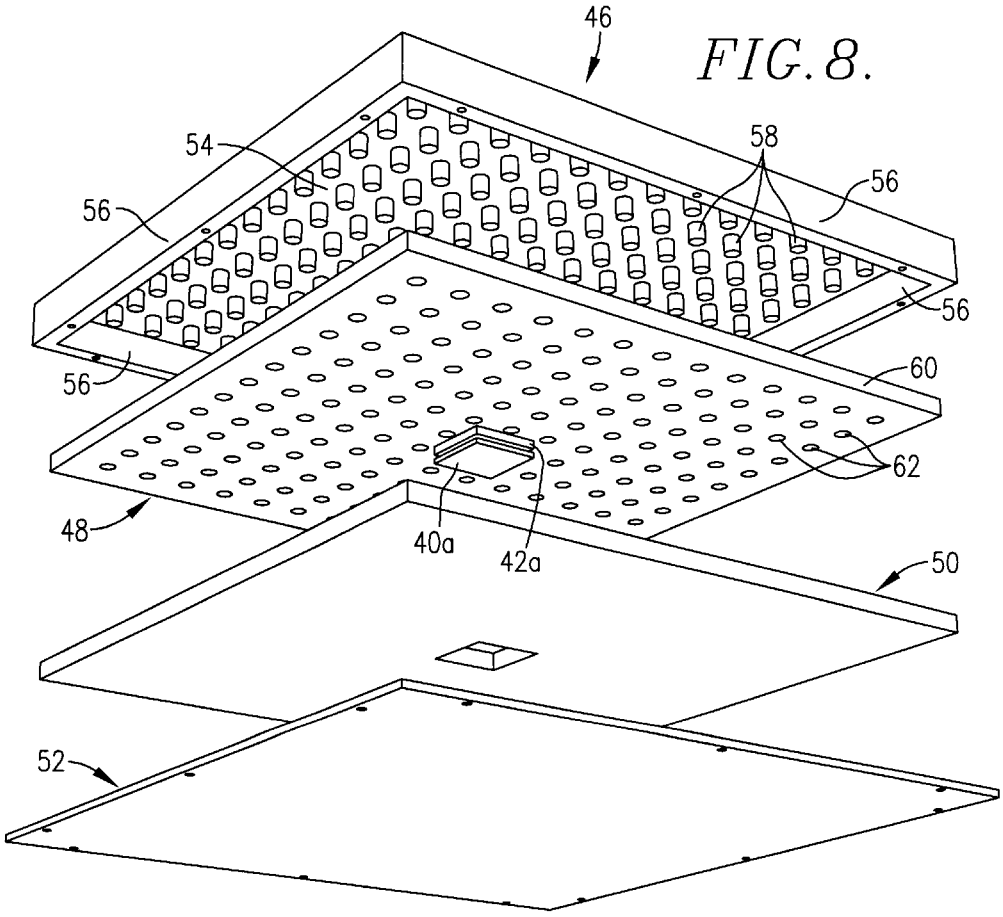
FIG. 8 is an exploded view of the peg-type core of FIG. 7.

The thermal seats 10 may also include a peg-type core 22*a* as illustrated in FIGS. 7 and 8 rather than the laminated core 22 described above. The peg-type core 22*a* broadly includes an induction-heatable layer 46, a heat-retentive layer 48, thermal insulation layer 50, and a bottom panel 52 that secures the heat-retentive layer 48 and insulation 50 to the induction-heatable layer 46.

The induction-heatable layer 46 is preferably formed from BMC 940™. BMC 940™ is a graphite-filled polymer material sold by Bulk Molding Compounds, Inc. of West Chicago, Ill. as described above. The induction-heatable layer 46 is preferably compression molded to include a generally flat, planar top panel 54, four depending peripheral sidewalls 56, and a plurality of "pegs" 58 depending from the top panel 54 in the same direction as the side walls 56.

The heat retentive layer 48 includes a generally flat planar panel 60 having a grid-work of holes 62 formed therein aligned with the pegs 58 of the induction-heatable layer 46. As best illustrated in FIG. 7, the heat-retentive layer 48 fits within the confines of the depending sidewalls 56 so that the pegs 58 are received within the grid-work of holes 62 to create an intimate thermal contact therebetween. The preferred heat retentive layer 48 is formed of solid-to-solid phase change material such as the cross-linked polyethylene material or UHMW described in the '585 patent. The phase change temperature of the material is preferably somewhere between 220° F. and 265° F.

The thermal insulation layer 50 is preferably made from MANNIGLASS™ V1200 or V1900 sold by Lydall of Troy, N.Y., and is placed below the heat retentive layer 48 so as to be in thermal contact with the ends of the pegs 58 and the bottom surface of the heat retentive layer 48. An RFID tag 40*a,* such as the one described above, is placed in a cutout 64 of the insulation layer 50. The RFID tag 40 a may be connected electrically to a thermal switch 42*a* placed in thermal contact with the heat retentive layer 48 so as to temperature regulate the core 22*a* in accordance with the teachings of the '585 patent. The bottom panel 52, which is preferably formed of high temperature rigid plastic such as BMC 310, is then secured or adhered to the depending sidewalls 56 of the induction heatable layer 46.

As with the laminated core 22 described above, the peg type core 22*a* can be heated by an induction heater to a temperature just above the phase change temperature of its heat retentive layer 48 and be maintained there. After the thermal seat 10 is removed from the induction heater, the heat retentive phase change layer 48, having been heated above its phase change temperature of somewhere between 220° F. and 265° F., has a vast quantity of latent and sensible heat to release. Due to the high R value thermal insulation layer 26, the released heat is preferentially driven upward toward the phase change foam 24. This phase change foam 24 buffers the surface temperature of the thermal seat's cover 28 so that the customer feels a comfortable temperature for a prolonged period of time.

Thermal Seat with Matrix-Type Core

The thermal seats 10 may also include a matrix-type heat retentive core 22*b* rather than the laminated core 22 described above. As illustrated in FIG. 9, the matrix-type core includes an induction-heatable layer 66, a layer of heat-retentive phase change material 68, and a bottom panel 70 for securing the phase change material to the induction-heatable layer 66.

The induction-heatable layer 66 is preferably composed of a blend of BMC 940™ resin material, graphite flakes, and ground crosslinked polyethylene as described in the '585 patent. Prior to compression molding, these ingredients are mixed in the following approximate proportions: 50% by weight BMC 940™ resin, 10% by weight graphite flakes, and 40% by weight ground crosslinked polyethylene.

The resultant material is inductively heatable, compression moldable, and capable of storing latent heat at the phase change temperature of the crosslinked polyethylene used. The heat-retentive phase change layer 68 and bottom panel 70 are identical to the same named components described above in connection with the peg-type core 22*a*.

Pellet-Type Core

The thermal seats 10 may also include a pellet-type core such as the one disclosed in the '169 patent. For the present invention, however, the surface ribs shown in the '169 patent are preferably removed. The pellet-type core also preferably includes a heat-retentive phase change layer, bottom panel, RFID tag, and thermal switch as described above.

Other Food Delivery Containers and Devices

The four embodiments of the induction-heatable core 22 described above can also be embedded in food delivery containers and other devices that can be heated and temperature regulated by the heating/vending system described herein. One such food delivery container, described in the '585 patent, is in the form of a pizza delivery bag. Such a food delivery container can be automatically temperature regulated at the proper temperature by the induction heaters of the charging/vending station 12. Thus, a vendor could heat these food delivery containers with the same heaters used to heat thermal seats 10.

Charging/Vending Station

The charging/vending station 12 is illustrated in FIG. 1 and is similar to the charging station disclosed in the '585 patent. The preferred charging/vending station 12 includes a table 72 equipped with two or more laterally spaced apart magnetic induction charging stations 74*a, b.* The top of the table has two spaced openings therein, to accommodate the respective stations 74*a, b.* Each of the latter are identical, and include an upright, open-front, polycarbonate locator/holder 76*a, b,* each having a base plate 78, upstanding sidewalls 80, and back wall 82. Each station 74*a, b* includes a magnetic induction cooktop 84*a, b* directly below its locator/holder 76*a, b* and connected with the base plate 78 of a locator/holder 76*a, b,* as well as a user control box 86*a, b.* The control box 86*a, b* may include a regulation temperature readout, an input device allowing a user to select a desired regulation temperature within a given range, a power switch, a reset switch, a red light to indicate "charging", and green light to indicate "ready", and a light to indicate "service required".

Each cooktop 84*a, b* is preferably a COOKTEK™ Model CD-1800 magnetic induction cooktop having its standard ceramic top removed and connected to a locator/holder 76*a, b.* The microprocessor of the cooktop is programmed so as to control the cooktop in accordance with the preferred temperature control method disclosed in the '585 patent. Each cooktop 84*a, b* is designed to produce an alternating magnetic field in the preferred range of 20–100 kHz. It will be understood that COOKTEK™ Model CD-1800 is but one example of a magnetic induction heater that may be used with the present invention and a variety of other commercial available cooktops of this type can be used. Also, more detailed descriptions of magnetic induction cooktop circuitry can be found in U.S. Pat. Nos. 4,555,608 and 3,978,307, which are incorporated by reference herein.

A pair of spaced apart photo sensors (not shown) may be positioned within each locator/holder 76*a, b.* The photo sensors are coupled with the microprocessor circuitry control of the cooktops 84*a, b* and serve as a sensor for determining when a thermal seat 10 is located on one of the cooktops 84*a, b.* When a thermal seat 10 is placed upon a cooktop, the photo sensors will send an initiation signal to the microprocessor allowing it to initiate a heating operation. It will be understood that a variety of different sensors can be used in this context, so long as the sensors can discriminate between an appropriate thermal seat, food container, or other heating element and other objects which may be improperly or inadvertently placed upon the cooktop. The simplest such sensor would be a mechanical switch or several switches in series so placed on the base plate so that only the proper thermal seats or food delivery containers would activate the switch or switches. Other switches such as proximity switches or light sensor switches (photosensors) could be substituted for press-type switches.

Although the photo sensors described above are effective for some applications, the charging/vending station 12 preferably makes use of a more advanced locating sensor using Radio Frequency Identification (RFID) technology. RFID is similar to barcode technology, but uses radio frequency instead of optical signals. An RFID system consists of two major components, a reader and a special tag or card. In the context of the present invention, a reader (87 in FIG. 6) would be positioned adjacent each base plate in lieu of or in addition to the photo sensors whereas the corresponding tags (40 in FIG. 6) would be associated with the thermal seats 10. The reader 87 performs several functions, one of which is to produce a low level radio frequency magnetic field, usually at 125 kHz or 13.56 MHz, through a coil-type transmitting antenna 88. The corresponding RFID tag 40 also contains a coil antenna and an integrated circuit. When the tag 40 receives the magnetic field energy of the reader 87 and antenna 88, it transmits programmed memory information in the IC to the reader 87, which then validates the signal, decodes the data to the control unit of the cooktops 84*a, b* or to a separate control unit.

RFID technology has many advantages in the present invention. The RFID tag 40 may be several inches away from the reader 87 and still communicate with the reader 87. Furthermore, many RFID tags are read-write tags and many readers are readers-writers. The memory contents of a read-write tag may be changed at will by signals sent from the reader-writer. Thus, a reader (e.g., the OMR-705+ produced by Motorola) would have its output connected to the cooktop's microprocessor, and would have its antenna positioned beneath the base. Each corresponding thermal seat includes an RFID tag 40 (e.g., Motorola's IT-254E) such that when a thermal seat 10 with an attached tag 40 is placed upon a locator/holder 76*a, b* the communication between the seat tag 40 and the reader 87 generates an initiation signal permitting commencement of the heating cycle. Another type of object not including an RFID tag placed on the cooktop would not initiate any heating.

The charging/vending station 12 also preferably includes a cash register 90 with a credit card reader 92 in communication with the cooktops 84*a, b* so that the information from a customer's credit card can be written to the RFID tag 40 of a thermal seat 10 being vended to the customer. One credit card reader is preferably connected to all the induction cooktops 84*a, b* with a microprocessor controlling the flow of information.

To use the charging/vending station 12, a vendor simply places a thermal seat 10 onto a locator/holder 76*a, b*. The reader 87 of the charging station 74*a, b* immediately recognizes the class of object code on the RFID tag 40 attached to or embedded in the thermal seat 10 and executes a specific heating algorithm designed to efficiently bring the seat to a pre-selected temperature and maintain it there without input from the user. This method is fully described in the '585 patent. While the thermal seat 10 is being heated, the vendor takes the customer's credit card and scans it through the credit card reader 92. All or a portion of the user's credit card number is transferred to the RFID tag 40 embedded in the seat 10 being heated on the appropriate charging station 12. Furthermore, the time and date that the heating operation takes place is also written to the RFID tag 40. After the information is transferred and the seat 10 has been fully heated, the "ready" light illuminates and the vendor gives the thermal seat 10 to the customer. The customer is advised that a rental fee will be charged to the credit card once he returns the seat 10 to the check-out station. The customer is further advised that a full replacement fee may be charged to the credit card if the seat 10 is not returned.

Because of the flexibility of the RFID-based induction heating method, the same charging/vending station 12 may be used to automatically heat and temperature regulate other objects such as food delivery containers.

Self-serve Warming Station

The self-serve warming station 14 is illustrated in FIG. 2 and is similar to the charging/vending station 12 but lacks the cash register and credit card reader. The purpose of the self-serve warming station 14 is to allow customers to reheat vended thermal seats 10 should the seats not stay warm during the entire duration of an event. Furthermore, a customer who has purchased a thermal seat can use the warming station 14 to heat his or her thermal seat 10 without standing in the line at the charging/vending station 12. Finally, a vendor may use the warming station 14 to initially heat or reheat a food delivery container or other such device. Many self-serve warming stations could be placed at strategic locations around a stadium to allow easy access for customers. Simple instructions at the station, coupled with the simple operation of the induction heaters, allows customers to easily and safely heat their thermal seats 10 and other induction-heatable objects.

Check-Out Station

The checkout station 16 is illustrated in FIGS. 3 and 4 and includes a substantially enclosed housing 94 having one or more openings or "chutes" 96 into which thermal seats 10 and other induction-heatable objects may be placed so as to irretrievably fall into the housing 94. Referring to FIG. 4, an RFID antenna 98 is positioned adjacent each chute 96 and is in communication with an RFID reader/writer 100 and microcontroller control unit 102. The RFID antenna 98 reads the RFID tag 40 of a thermal seat 10 as it is deposited in the housing 94. The RFID reader/writer 100 and microcontroller control unit 102 communicate with a receipt printer 104 to dispense a receipt shortly after a seat 10 has been placed into a chute 96. The microcontroller control unit 102 also stores transaction information, including the time and date each seat was returned, so that the information can be immediately or subsequently retrieved either through a direct cable connection, a modem, or a wireless modem. The transaction information can then be compiled with that of other check-out stations so as to effectively monitor the status of all vended thermal seats 10.

The control unit 102 preferably has a user interface 106 similar to those found in other automated vending systems such as self-serve gas pumps. The user interface 106 instructs a customer to place a thermal seat 10 into the chute 96 and to take his or her receipt from the receipt printer. The simple operation of the check-out station 16 allows a large number of thermal seats 10 to be returned quickly without intervention by paid staff members.

The preferred RFID reader/writer 100 is a Medio LS200 Packaged Coupler manufactured and sold by Gemplus of France. This coupler is ideal for this application because it can simultaneously control 4 different RFID antennas and process the communications to those antennas. The preferred RFID antenna 98 is an Aero LC antenna. This antenna is large enough to easily read the RFID tag 40 on a thermal seat 10 as it slides down one of the chutes 96.

The RFID reader/writer 100 and microcontroller control unit 102 with user interface 106 communicates with the receipt printer 104 to dispense a receipt to a customer seconds after the customer's seat has been placed into one of the chutes. The receipt preferably lists the vending time, check-out time, credit card charge, and any other useful information. The checkout station 16 also calculates how much time has elapsed between vending and return of a seat and may charge a late fee to the customer's credit card, if appropriate.

The control unit 102 also stores transaction information, including the time and date each seat is returned, so that it can be retrieved by the vendor either through a direct cable connection, a modem, or a wireless modem. This retrieval can be either simultaneous with the transaction or delayed. In either case, the transaction information can be compiled with that of other check-out stations so as to effectively monitor the status of all vended thermal seats.

The checkout station 16 also preferably has a locked rear access door that may be opened by an authorized person to retrieve returned thermal seats 10 and bring them back to the charging/vending station 12.

EXAMPLES

The following examples set forth presently preferred methods for the production of several embodiments of the laminated core 22, thermal seat 10, and heating/vending system of the present invention. It is to be understood, however, that these examples are provided by way of illustration and nothing therein should be taken as a limitation upon the overall scope of the invention.

Example 1

In this example, a laminated core 22 was constructed by a process of vacuum lamination. First, the components or layers were manually assembled in the following order wherein layer 1 is the topmost layer as viewed from the perspective of FIG. 6:

| Layer | Thickness | Ingredient | Density | Melting Point |
|---|---|---|---|---|
| 1 | .060 inches | LDPE[1] | .93 g/cucm | 230° F. |
| 2 | .030 inches | GRAFOIL ® | 70 lb/cuft | n/a |
| 3 | .060 inches | LDPE | .93 g/cucm | 230° F. |
| 4 | .030 inches | GRAFOIL ® | 70 lb/cuft | n/a |
| 5 | .060 inches | LDPE | .93 g/cucm | 230° F. |
| 6 | .030 inches | GRAFOIL ® | 70 lb/cuft | n/a |
| 7 | .060 inches | LDPE | .93 g/cucm | 230° F. |

[1]Low Density Polyethylene

The third layer of LDPE (Layer 5) was die cut with a 1.25" diameter hole. The third layer of GRAFOIL® (Layer 6) and the second layer of GRAFOIL® (Layer 2) were also die cut with a 2.5" diameter hole. The hole in the sehe second layer of GRAFOIL® was necessary to minimize interference with the front of the RFID tag 40 surface. The die cutting process was conducted prior to manual assembly of the laminated core 22 specified in the table above.

The RFID tag 40 and thermal switch 42 were then connected and potted with epoxy resin. The resulting structure was approximately 1.25" in diameter and 0.30" thick. The RFID tag/thermal switch structure was placed into the hole of the third layer of GRAFOIL® (Layer 6) with the thermal switch facing down. Next, epoxy resin was added into the hole. The entire structure was then vacuum laminated according to the following specifications:

| | |
|---|---|
| Time | 1.7 min. |
| Temperature | 400° F. |
| Evacuation Atmospheric Pressure | 550 mm Hg |
| Platen Pressure | 50 psi |

Heat from the vacuum lamination process cured the epoxy resin resulting in a RFID tag/thermal switch structure approximately 0.275–0.30" in height.

The entire laminated core 22 was able to heat at about 230° F. in approximately 20 seconds. By comparison, a metal disc core heated to approximately the same temperature in about 2 hours and 15 minutes. Furthermore, the graphite laminated core 22 is approximately half the weight of the metal disc core. Testing showed that three layers of 0.30" GRAFOIL® resulted in full efficiency of the laminated core 22 without superheating the LDPE layers.

Example 2

In this example, a laminated core 22 was constructed using the same vacuum lamination process discussed above, but without the addition of the RFID tag/thermal switch. The laminated structure was comprised of high density and low density polyethylene sheets in addition to the GRAFOIL® layers. The laminated core 22 was manually assembled in the following order wherein layer 1 is the topmost layer:

| Layer | Thickness | Ingredient | Density | Melting Point |
|---|---|---|---|---|
| 1 | .030 inches | HDPE[1] | .95 g/cucm | 255° F. |
| 2 | .040 inches | LDPE | .93 g/cucm | 230° F. |
| 3 | .030 inches | GRAFOIL ® | 70 lb/cuft | n/a |
| 4 | .060 inches | HDPE | .95 g/cucm | 255° F. |
| 5 | .030 inches | GRAFOIL ® | 70 lb/cuft | n/a |
| 6 | .060 inches | HDPE | .95 g/cucm | 255° F |
| 7 | .030 inches | GRAFOIL ® | 70 lb/cuft | n/a |
| 8 | .040 inches | LDPE | .93 g/cucm | 230° F. |
| 9 | .030 inches | HDPE | .95 g/cucm | 255° F. |

[1]High density polyethylene

The vacuum lamination was conducted according to the following specifications:

| | |
|---|---|
| Time | 1.7 min. |
| Temperature | 400° F. |
| Evacuation Atmospheric Pressure | 550 mm Hg |
| Platen Pressure | 50 psi |

As noted in the table above, the melting point of the HDPE is higher than the LDPE as a function of its increased specific density. The use of HDPE permits one to apply more current to the structure because HDPE will not phase change at lower temperatures. Furthermore, using HDPE allows for greater latent heat storage. Lastly, the HDPE acts to buffer the exterior of the laminated structure from the softened LDPE when HDPE is positioned as the outer layers of the structure.

A laminated core 22 comprising a combination of the HDPE/LDPE and flexible graphite layers would heat at 230° F. in less time than the structure described in Example 1. Evidently, the benefits of using anisotropic material in addition to LDPE would be augmented by using HDPE, because the HDPE is more resistant to phase change and can store more latent heat than LDPE alone.

Example 3

In this example, a peg-type core 22*a* was formed using a compression molding tool. 0.25" holes were drilled into a 0.25" thick sheet of HDPE. The HDPE used had a 12" by 12" dimension simply to conform to the dimensions of the compression molding tool. Next, the BMC 940™ resin, a graphite resin having filler sold by Bulk Molding Compounds, Inc., was applied onto the pre-drilled sheet of HDPE. The entire structure was then compression molded according to the following specifications:

| | |
|---|---|
| Time | 35 min. |
| Temperature | 375° F. |
| Platen Pressure | 50 psi |

The primary objective in making the pins of the BMC 940™ resin to cooperate with the holes of the HDPE was to create a close intimate relationship between the two materials thereby effectuating an efficient transfer of energy from the heat inductable material (BMC 940™) to the heat retentive material (HDPE). This core simply was not as efficient as the laminated cores discussed in Examples 1 and 2, but can work as a replacement.

Example 4

In this example, a matrix-type core 22*b* was formed by kneading the following materials in a low-shear mixer for ten minutes or until completely mixed:

| Ingredient | Composition |
|---|---|
| BMC 940 ™ | 50% |
| Graphite Flakes | 10% |
| Ground Linear LDPE | 40% |

Testing of this core 22*b* revealed that the matrix core coupled less energy than a core constructed without the addition of the LDPE. The graphite flakes were added in order to increase the low resistance in the across-plane and high resistance in the through-plane of the core, i.e, to increase anisotropy. The resulting mixture was compression molded into increasingly thinner plates in order to construct an increased anisotropic structure. The thinnest plate created had a thickness of 0.40". The addition of graphite resulted in improved coupling, but was not as efficient as using flexible graphite or using BMC 940™ alone with graphite flakes because LDPE interfered with the conductivity of the core in the across plane of the material.

Example 5

In this example, a thermal seat 10 having a dimension of 16×16 inches was constructed comprising a nylon delivery bag, two gel pads developed by Pittsburgh Plastics, four laminated cores, HDPE, and vacuum insulation panels. The laminated cores were constructed according to Example 1 above, but without the molded RFID tags. The T95® and T122® gel pads, as sold by Pittsburgh Plastics, were used to create a temperature gradient. The gel pads are thought to comprise approximately 40% by weight THERMASORB™ (a solid-to-solid phase change material) and filler material. The T95® pad was placed closest to the seat exterior, i.e., area coming into contact with the posterior of the seat user. The T122® gel pad was placed between the induction heatable body and the T95® gel pad. The T122® gel pad has a phase change temperature of 122° F. and the T95® gel pad has a phase change temperature of 95° F.

The seat 10 was constructed with four laminated cores 22 placed into a nylon housing. Four laminated cores 22 mated to four induction coils were required to heat the seat at 20,000 watts because the largest magnetic induction heating machines conducts at 5,000 watts of energy. The laminated cores were not comprised of molded RFID tags 40. Rather, the RFID tags 40 were placed within the surface of the nylon housing. The magnetic flux generated eddy currents through the laminated structure. The anisotropic nature of GRAFOIL® permits the GRAFOIL® to reach instantaneous thermal equilibrium in the across-plane of the material without superheating. The anisotropic property referred to, in this case, is the relatively low resistance in the across-plane of the GRAFOIL® in contrast to the high resistance in the through-plane which results in an even rate of heating throughout the laminated structure. The T122® gel pad accepted the heat from the laminated core and then transferred excess heat to the T95® gel pad. The effectuated phase change in the gel pads resulted in a comfortable posterior temperature of from about 90–95° F. for about 5 hours. The phase change material also provided extra cushioning for the seat user.

Example 6

In this example, a thermal seat heating/vending system was constructed with the following parts: a check-out station and a check-in station. The check-out station comprised a simulated cash register and an RFID Reader/Writer Platform. The simulated cash register further comprised a Laptop computer, a credit card reader, and a receipt printer. The RFID Reader/Writer Platform was linked to the laptop computer. The customer's credit card is scanned through the credit card reader and the customer information is programmed into the RFID tag for future reference. At this stage, the RFID tag contained customer information, check-out time, and temperature regulation information. The seat is placed onto the platform and heated by magnetic induction.

The check-in station comprised a RFID Reader/Writer Platform with a top and bottom panel defining a slot wherein a seat having an RFID Tag can be inserted. The check-in station further comprised a receipt printer and a wireless network connecting a simulated LCD screen and database. The customer can return the seat at the check-in station by placing the seat into the slot. The check-in station gives the customer a receipt. The check-out time and customer information is stored for the vendor's use.

A third component of this station is envisioned to be a self-serve warming station whereby a consumer can reheat the thermal seat during the event. The self-serve warming station is comprised of a single or plurality of warming trays having induction heaters with RFID Reader/Writer Platforms. The self-serve warming station has a light system to indicate charging and readiness. A red light indicates charging and a green light indicates that the seat is ready for reuse. The customer simply places the seat onto the warming trays to reheat the seat without waiting in line at the check-out station.

Embodiments of FIGS. 10–16

Figure 10:
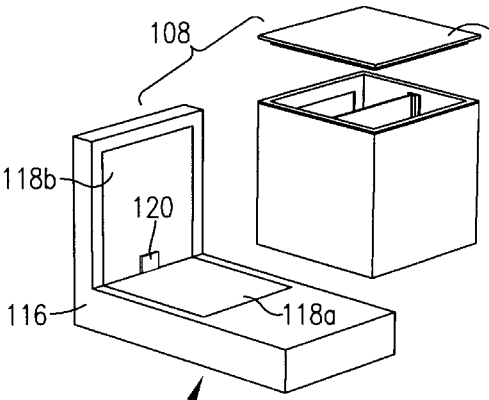
FIG. 10 is a perspective view of a magnetic induction heater and heat retentive food container constructed in accordance with a preferred embodiment of a food delivery assembly of the present invention.
Figure 12:
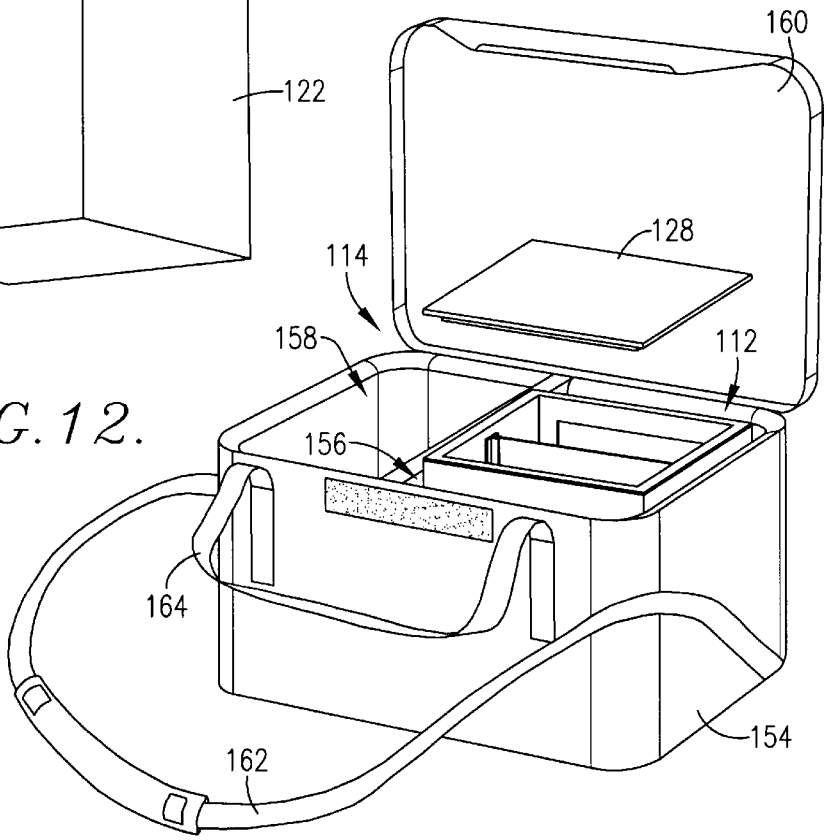
FIG. 12 is a perspective view of a delivery bag in which the food container may be positioned.

FIGS. 10–16 illustrate a food delivery assembly 108 especially configured for delivering and maintaining the temperature of food items other than pizza. The preferred food delivery assembly 108 is configured for use in keeping sandwiches and french fries, such as those sold by the McDonald's Corporation, hot during delivery, but may also be configured for holding other food items conventionally sold by fast food restaurants. As best illustrated in FIGS. 10 and 12, the food delivery assembly 108 broadly includes a magnetic induction heater 110, a food container 112 that may be heated on the heater 110, and a delivery bag 114 for carrying and insulating the food container 112.

The magnetic induction heater 110 operates under the same principle as the heaters disclosed above and in the '585 and '169 patents but is specially sized and configured for heating the food container 112 of the present invention. To this end, the preferred magnetic induction heater 110 includes an L-shaped base or body 116 with an induction heating coil 118*a, b* positioned in or on each leg of the body 116. The magnetic induction coils 118*a, b* are controlled by a common control source (not shown) and are coupled with an RFID reader/writer 120 that operates as described above.

The food container 112 is best illustrated in FIG. 12 and includes an outer, open-topped box 122, an inner, open-topped box 124 that fits within the outer box 122, a divider wall assembly 126 that fits within the inner box to subdivide it into several adjacent chambers for carrying a plurality of food items, and a lid 128 that fits over the open top of the inner box 124 to substantially seal the food container 112 and retain heat therein. As mentioned above, the food container 112 may be sized and configured for holding any types of food items. In one embodiment, the inner box 124 and the divider wall assembly 126 are configured to subdivide the food delivery container so as to hold several sandwiches and french fry cartons such as those sold by the McDonald's Corporation.

Figure 14:
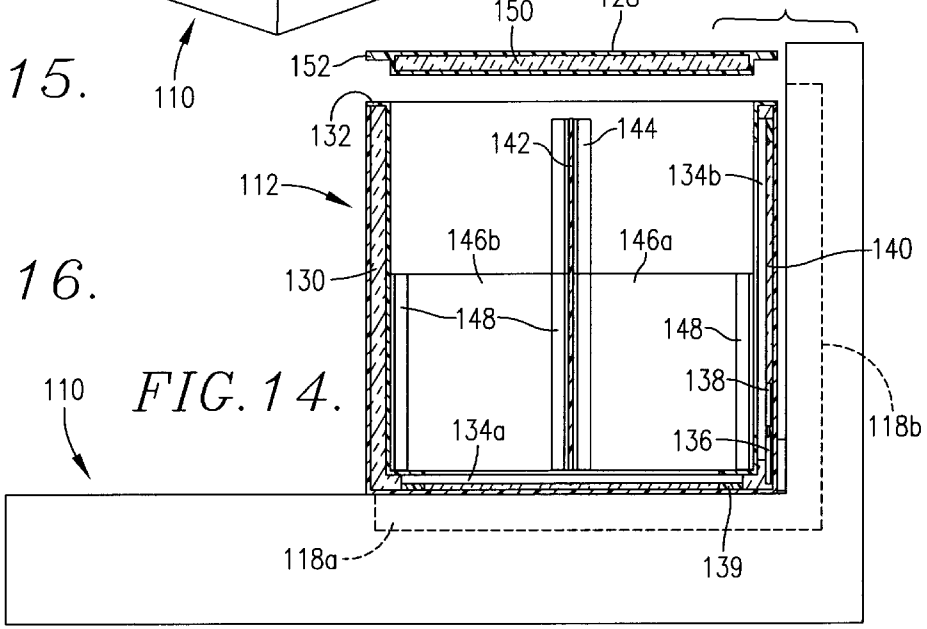
FIG. 14 is a vertical section view of the food container placed on the induction heater.

The outer box 122 is preferably generally cube-shaped and may be formed of any suitable material such as synthetic resin materials. A layer of insulation 130 is preferably positioned along the interior walls of the box as best illustrated in FIG. 14.

The inner box 124 is sized and configured to fit snugly within the outer box 122 and is therefore also preferably cube-shaped. The top edge of the inner box 124 includes a horizontally-projecting lip 132 that fits over the top edge of the outer box 122 when the inner box 124 is inserted therein. The inner box 124 includes two induction-heatable cores: one 134*a* positioned on the bottom panel of the box and another 134*b* positioned on one of the side walls of the box. The induction-heatable cores 134*a, b* are sized and oriented so as to be positioned adjacent the induction heating coils 118*a, b* of the induction heater when the food container 112 is placed on the heater 110 as best illustrated in FIG. 14. The induction-heatable cores 134*a, b* are preferably substantially identical to the laminated core 22 described above in connection with the thermal seat heating/vending system but may also be constructed in accordance with the other embodiments of induction-heatable cores described herein.

An RFID tag 136 and thermal 138 switch are coupled with the induction-heatable cores 134*a, b* and operate in the same manner as the same named components described above. The RFID tag 136 is oriented so as to be adjacent the RFID reader/writer 120 on the induction heater 110 when the food delivery container 112 is placed on the heater as illustrated in FIG. 14.

A support bracket 139 or gasket is positioned in the bottom of the outer box 122 so as to support and prevent damage to the induction-heatable core 134*a* positioned on the bottom panel of the inner box 124. Likewise, a similar support bracket 140 or gasket is positioned along one of the interior side walls of the outer box 122 so as to support and protect the induction-heatable core 134*b* positioned on the side wall of the inner box 124.

Figure 15:
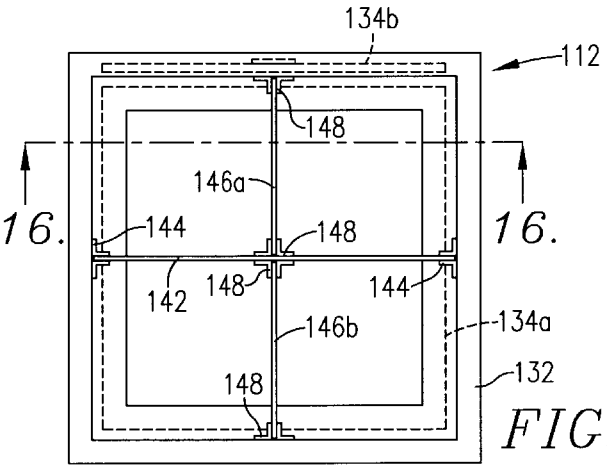
FIG. 15 is a plan view of the food container of FIG. 10 with its lid completely removed.
Figure 16:
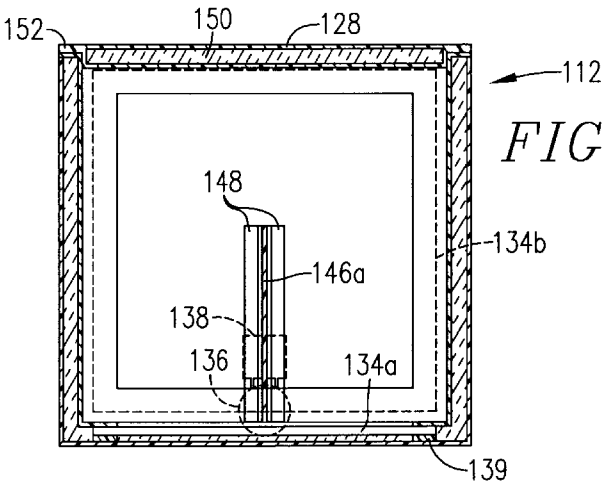
FIG. 16 is a vertical section view of the food container taken along line 16—16 of FIG. 15.
Figure 13:
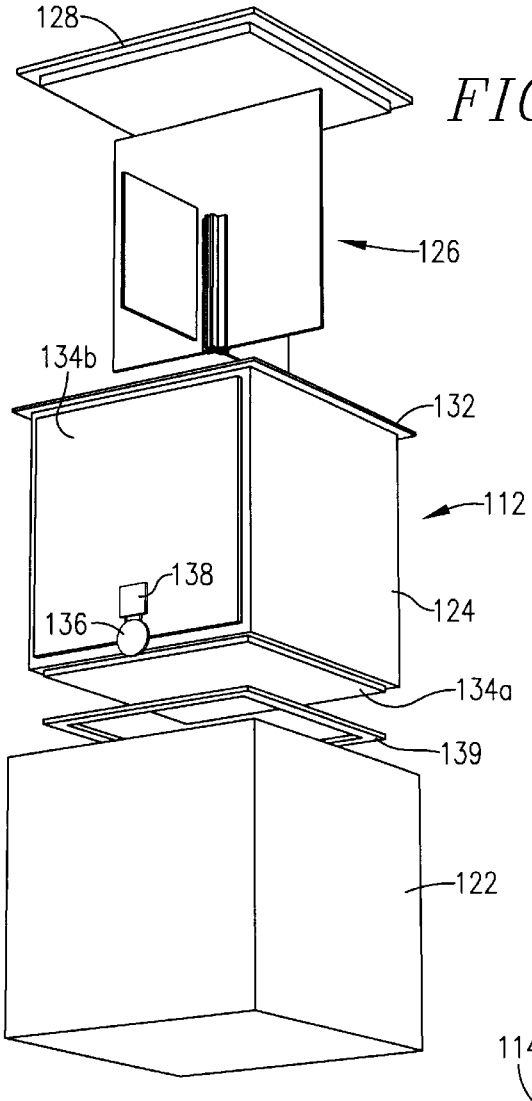
FIG. 13 is an exploded view of the components of the food container of FIG. 11.
Figure 11:
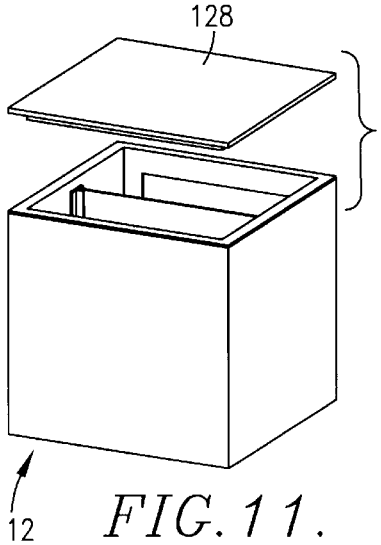
FIG. 11 is a perspective view of the food container of FIG. 10 with its lid removed.

As best illustrated in FIGS. 15 and 16, the divider wall assembly 126 includes a tall divider wall 142 received within divider guides 144 positioned on opposite interior walls of the inner box 124 and two short divider walls 146*a, b* received within divider guides 148 positioned on opposite interior walls of the inner box 124 and along the center of the tall divider wall 142. The divider walls may be easily removed and/or interchanged to alter the carrying configuration of the inner box 124.

The lid 128 is sized to fit snugly over the open top of the inner box 124 to seal the food delivery container and retain heat therein. The lid preferably includes an internal layer of insulation 150 and a horizontally-projecting lip 152 that rests over the lip 132 of the inner box 124.

The delivery bag 114 is preferably formed of flexible, lightweight, insulative material and includes a base 154 having an internal chamber or compartment 156 for receiving the food container 112. The bag 114 also preferably includes a second compartment 158 for receiving food items that are not to be warmed during delivery, such as soft drinks. A closure flap 160 or lid is hinged to one side of the base 154 and may be closed over the base 154 and held in place with Velcro or any other fastener to insulate both the food container 112 and the cold soft drinks contained in the base 154, The bag also preferably includes one or more carrying straps 162 or handles 164.

In use, the food container 112 may be placed on the heater 110 to initially heat the induction-heatable cores 134*a, b* positioned on the inner box 124. The RFID reader/writer 120 of the heater and the RFID tag 136 and thermal switch 138 of the food container 112 operate as described above to heat the food container 112 to a desired temperature and to maintain that temperature for a long period of time. Once the food container has been heated, it may be removed from the heater and placed into one compartment of the bag as illustrated in FIG. 12. Hot food items may then be inserted in the food container and cold food items such as soft drinks positioned in the compartment next to the food container 112 so that the ideal temperature of all of the food items contained in the bag may be maintained during delivery.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A method of vending thermal seats, the method comprising the steps of:

providing a plurality of thermal seats, each seat having an RFID tag associated therewith, and each seat including — an induction-heatable body including a plurality of discrete induction-heatable elements, each including graphite material, and heat retentive synthetic resin material located adjacent the elements and operable to serve as a heat sink upon magnetic induction heating of the elements, the elements characterized by the property of substantially simultaneous heating thereof by an externally applied magnetic field, and a cover surrounding the body and including a cushioning component over the body and presenting a seating surfaces;

heating one of the seats for a customer;

storing customer-specific information in the RFID tag of the seat; and providing a check-out station for return of the seat after the customer's use thereof, the station including a seat-receiving housing and an RFID tag reader operable to obtain information from the RFID tag when the customer deposits the seat in the housing and, in response to the obtainment of information, generating a receipt for the customer confirming return of the seat.

2. The method as set forth in claim 1, further including the step of reading information from the RFID tag of the seat to obtain information to be used when heating the seat.

3. The method as set forth in claim 1, wherein the heating step is performed with a magnetic induction heater.

4. The method as set forth in claim 1, further including the step of providing a self-serve warming station for use by the customer in reheating the seat after the seat has been vended.

5. A system for heating, vending, and collecting thermal seats, the system comprising:

a plurality of magnetic induction-heatable thermal seats, each of the thermal seats including — an induction-heatable body including a plurality of discrete induction-heatable elements, each including graphite material, and heat retentive synthetic resin material located adjacent the elements and operable to serve as a heat sink upon magnetic induction heating of the elements, the elements characterized by the property of substantially simultaneous heating thereof by an externally applied magnetic field, and a cover surrounding the body and including a cushioning component over the body and presenting a seating surface;

a charging/vending station for heating and vending the thermal seats; and a check-out station for collecting the thermal seats after they have been used by consumers.

6. The system as set forth in claim 5, each of the thermal seats further including an RFID tag operable to store information thereon.

7. The system as set forth in claim 6, the charging/vending station including — a plurality of magnetic induction cooktops for heating the thermal seats, an RFID reader for reading information from the RFID tags of the thermal seats, and a credit card reader in communication with the RFID readers for delivering customer information to the RFID readers to be written to the RFID tags.

8. The system as set forth in claim 6, the check-out station including — a substantially enclosed housing having at least one chute formed therein for receiving thermal seats returned by consumers, an RFID reader positioned in the vicinity of the chute to read the RFID tags of the returned thermal seats, a control unit for obtaining information from the RFID reader, and a receipt printer coupled with the control unit for printing receipts when the thermal seats are returned.

9. The system as set forth in claim 5, further including a self-serve warming station including a plurality of magnetic induction cooktops for use by consumers to reheat thermal seats after the seats have been vended.

10. A method of vending thermal seats, the method comprising the steps of:

placing a thermal seat having an RFID tag associated therewith on a magnetic induction heater, wherein each of the seats includes — an induction-heatable body including a plurality of discrete induction-heatable elements, each including graphite material, and heat retentive synthetic resin material located adjacent the elements and operable to serve as a heat sink upon magnetic induction heating of the elements, the elements characterized by the property of substantially simultaneous heating thereof by an externally applied magnetic field, and a cover surrounding the body and including a cushioning component over the body and presenting a seating surface;

reading the RFID tag with an RFID tag reader associated with the heater;

heating the seat based at least partially upon information read from the RFID tag;

writing customer information onto the RFID tag with the RFID tag reader; and removing the thermal seat from the magnetic induction heater and giving it to a consumer.

11. The method as set forth in claim 10, further including the step of reading information from the RFID tag of the seat to obtain information to be used when heating the seat.

12. The method asset forth in claim 10, wherein the heating step is performed with a magnetic induction heater.

13. The method as set forth in claim 10, further including the step of providing a self-serve warming station for use by the customer in reheating the seat after the seat has been vended.

* * * * *